US006745752B1

(12) United States Patent
Jensen et al.

(10) Patent No.: US 6,745,752 B1
(45) Date of Patent: Jun. 8, 2004

(54) FUEL INJECTOR CLAMP WITH RETAINING RING

(75) Inventors: Daniel W. Jensen, Elmhurst, IL (US); Kenneth R. Seymour, II, Villa Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/369,399

(22) Filed: Feb. 19, 2003

(51) Int. Cl.[7] ..... F02M 55/02
(52) U.S. Cl. ..... 123/470; 24/457
(58) Field of Search ..... 123/470; 24/457

(56) References Cited

U.S. PATENT DOCUMENTS 4,066,213 A * 1/1978 Stampe ..... 239/533.3
5,111,794 A * 5/1992 DeGrace, Jr. ..... 123/470
5,566,658 A * 10/1996 Edwards et al. ..... 123/470
6,196,194 B1 * 3/2001 Mitchell ..... 123/470
6,431,152 B1 8/2002 Estacio

* cited by examiner

*Primary Examiner*—Thomas N. Moulis
(74) *Attorney, Agent, or Firm*—Susan L. Lukasik; Dennis Kelly Sullivan; Jeffrey P. Calfa

(57) ABSTRACT

An apparatus for and method of clamping a device (201), such as a fuel injector (201), to a platform (409), such as a cylinder head (409), allows the fuel injector (201) to be removed from the cylinder head (409) together with the clamp (105). A retaining ring (103) is secured between a conical surface (403) of the clamp (105) and an annular groove (307) of a fastener (101) disposed within the clamp (105). The retaining ring (103) secures the fastener (101) to the clamp (105) during removal of the fastener (101), thereby providing that the clamp assembly and the device, such as a fuel injector (201), are removed together.

20 Claims, 3 Drawing Sheets

FIG. 1
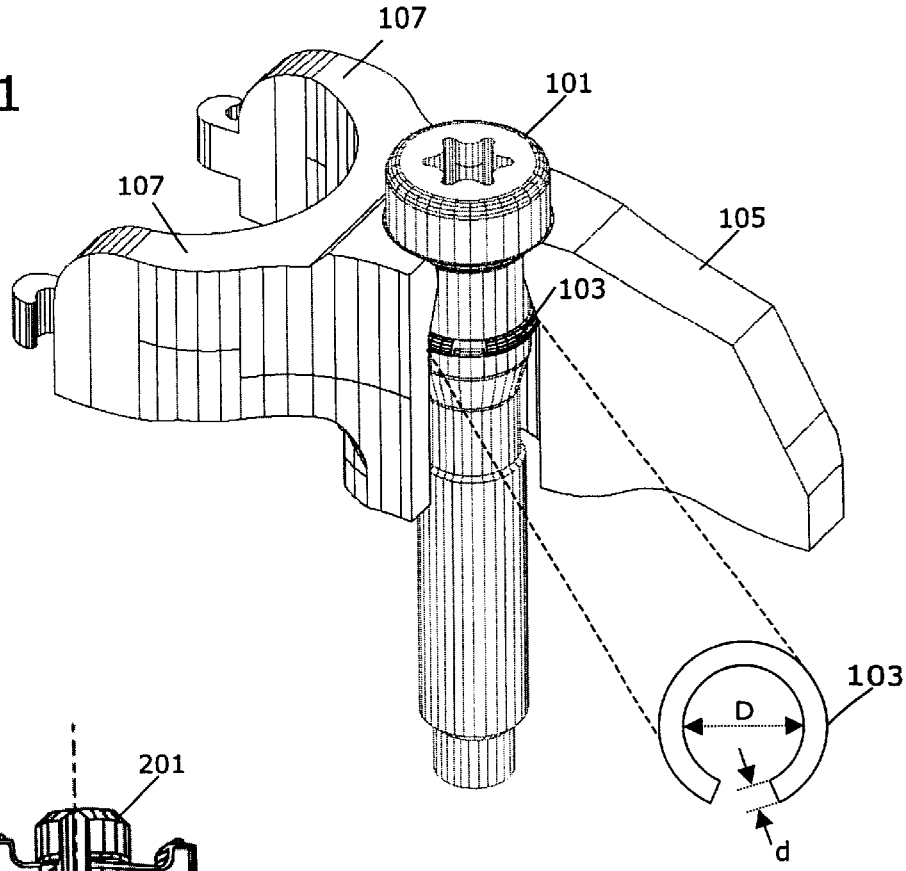
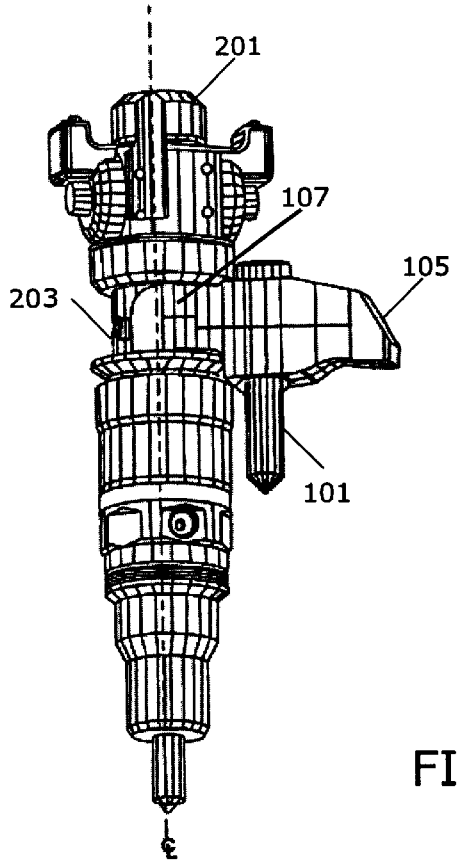
FIG. 2

FUEL INJECTOR CLAMP WITH RETAINING RING

FIELD OF THE INVENTION

This invention relates to fuel injector assemblies on cylinder heads in internal combustion engines, including but not limited to injector clamps that fasten fuel injectors to the cylinder head.

BACKGROUND OF THE INVENTION

The assembly of fuel injectors onto a cylinder head and the use of hold down clamps to secure the injector into the cylinder head are well known. Existing devices used to hold down or secure fuel injectors to cylinder heads are often impractical because such devices tend to be bulky, thereby adding to the crowding of components in the limited space on a cylinder head. Also, during disassembly or removal of the fuel injector from the cylinder head, the use of previous clamps typically requires that a tool pries the fuel injector from the cylinder head. Prying the fuel injector from the cylinder head frequently results in a damaged injector. Further, because the space around the fuel injector on the cylinder head is very limited, difficulty is encountered in prying the fuel injector from the cylinder head.

U.S. Pat. No. 6,431,152 titled "Injector Hold Down Clamp" describes a compact clamp assembly that allows for disassembly of a fuel injector from a cylinder head without the need to pry the fuel injector from the cylinder head. This patent describes the use of a bolt with a clamp and a retainer ring that holds the bolt to the clamp during injector removal. Nevertheless, the retainer ring could separate from the bolt, resulting in the need to manually pry the fuel injector from the cylinder head.

Accordingly, there is a need for an injector hold down clamp that provides for removal of the fuel injector from the cylinder head without the need to pry the fuel injector from the cylinder head and providing enhanced retention of the bolt in the clamp.

SUMMARY OF THE INVENTION

An apparatus includes a clamp for use with a device, such as a fuel injector, disposed with a platform, such as a cylinder head. The clamp has a passage that includes a conical surface. A fastener is disposed within the passage of the clamp and has an annular groove. A retaining ring is disposed in the annular groove. The retaining ring is secured between the conical surface of the clamp and the annular groove when the fastener is removed from the platform, such as a cylinder head, to thereby allow the apparatus to be removed together with the device, such as a fuel injector.

BRIEF DESCRIPTION OF THE DRAWINGS

FIG. 1 is a perspective view of an injector clamp with a cutaway view of a fastener and an interior surface of the injector clamp in accordance with the invention.

FIG. 2 is a perspective view of an injector clamp assembly disposed on a fuel injector in accordance with the invention.

DESCRIPTION OF A PREFERRED EMBODIMENT

The following describes an apparatus for and method of clamping a device, such as a fuel injector, to a platform, such as a cylinder head, and thereafter removing the device from the platform together with the clamp. A retaining ring is secured between a conical surface of the clamp and an annular groove of a fastener disposed within the clamp. The retaining ring secures the fastener to the clamp during removal of the fastener, thereby providing that the clamp assembly and the device, such as a fuel injector, are removed together. The retaining ring may be advantageously located during its entire travel within the clamp and away from passage ends, thereby preventing external objects from dislodging the ring.

A perspective view of an injector clamp with a cutaway view of a fastener and an interior surface of the injector clamp is shown in FIG. 1. A fastener 101, such as a threaded bolt, stud bolt, screw, and so forth, is secured by a retaining ring 103, such as a snap-ring, to a clamp 105. The clamp 105 has one or more mounting devices 107 that attach to a fuel injector such that the clamp 105 and the fuel injector are mountable to a cylinder head of an internal combustion engine via the fastener 101.

Figure 3:
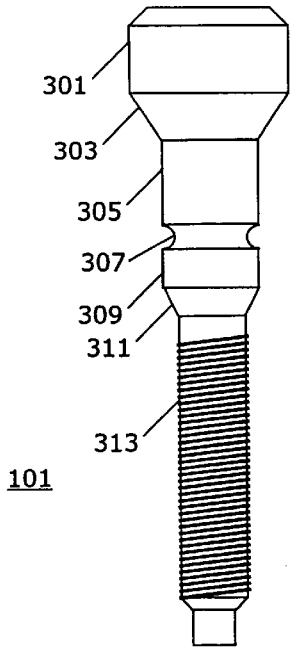
FIG. 3 is a side view of the fastener for the injector clamp in accordance with the invention.

A perspective view of an injector clamp assembly disposed on a fuel injector 201 is shown in FIG. 2. The mounting device 107 comprises a pair of arms that fit within a slot 203 of the fuel injector 201 to secure the clamp 105 to the fuel injector 201. The injector clamp assembly may be utilized in internal combustion engines, such as gas or diesel engines or in-line or V-type cylinder configurations or rotary or turbine engines, and so forth. A diagram illustrating the attachment of the injector clamp assembly with an injector 201 to an engine is shown in FIG. 3 of U.S. Pat. No. 6,431,152, the entirety of which is incorporated herein by reference.

A side view of the fastener for the injector clamp is shown in FIG. 3. The fastener 101 is advantageously a bolt or screw that is threaded to more securely hold the clamp 105 and fuel injector to the cylinder head. The fastener 101 has a head 301 with a slot (shown in FIG. 1) shaped to mate with a driver bit that is used to fasten the fastener to the cylinder head. An upper neck 303 tapers from the head 301 to a cylindrical segment that has an upper section 305 separated by an annular groove 307 from a lower section 309. The annular groove 307 may extend partially or completely around the fastener 101. For example, the gap in the retaining ring 103 may coincide with the region where the annular groove 307 does not extend. A lower neck 311 tapers from the lower section 309 of the cylindrical segment to a threaded section 313 of the fastener.

The fastener 101 may generally be manufactured utilizing the following process. The fastener 101 is cold rolled. A blanking process provides the shape of the head 301, the upper neck 303, and the cylindrical segment including the upper section 305 and the lower section 309 but without the annular groove 307 formed, and the lower neck 311 that tapers down to the pitch diameter of the threaded region 315. It is advantageous to locate the groove 307 as close to the head as the clamp 105 allows, enabling the bolt to swivel inside the clamp bore 305. The annular groove 307 may be rolled or cut into the fastener 101 at the desired location. Threads are rolled up threaded section 313. Other manufacturing processes may also be utilized.

The clamp 105 is advantageously comprised of cast metal that is quenched and tempered to Rc 45–55 standards, while the fastener 101 is advantageously comprised of class 12.9 phosphate coated metal. One of skill in the art readily recognizes that other types of materials may be utilized as long as the clamp 105 and fastener 101 secure the injector to the cylinder head while adequately withstanding any forces encountered during operation of the engine.

Figure 4A:
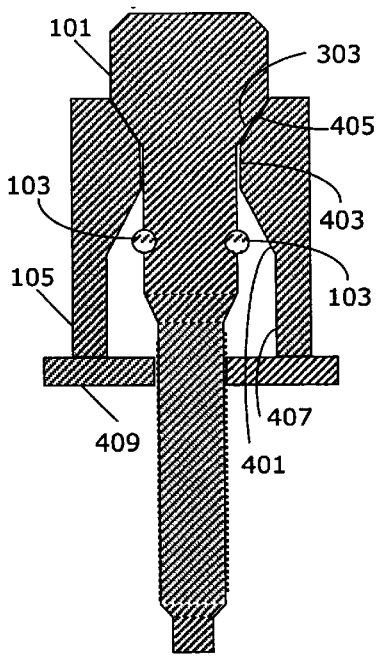
FIG. 4A and FIG. 4B are a cross-sectional views of the fastener disposed within the injector clamp in accordance with the invention.
Figure 4B:
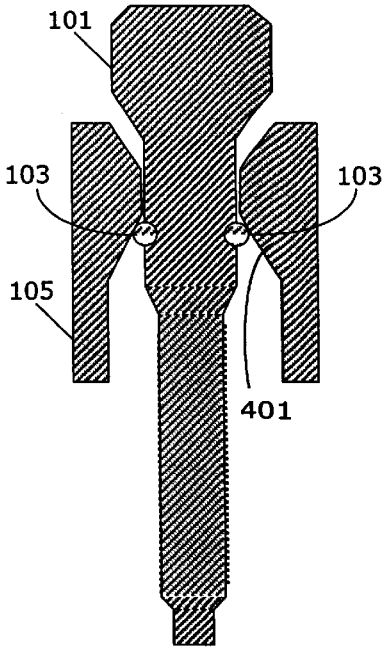

Cross-sectional views of the fastener 101 disposed within the clamp 105 are shown in FIGS. 4A and 4B. One end of the internal passage of the clamp 105 is characterized by a conical surface 401, a cylindrical surface 403, and a tapered surface 405. The second end of the internal passage, through which the threaded section 313 of the fastener 101 protrudes, also has a cylindrical shape 407. The angle of the conical surface 401 may vary relative to the cylindrical centerline. Shallower angles (e.g., those closer to 0 degrees) provide for better retention of the ring 103, whereas steeper angles (e.g., those closer to 90 degrees) convert torque more efficiently to axial pull force. When the fastener 101 is placed in the passage of the clamp 105 as shown, the upper neck 303 of the fastener 101 abuts against the tapered surface 405, thereby preventing the fastener 101 from continuing completely through the passage. The fastener 101 and clamp 105 are shown disposed with a platform 409, such as a cylinder head.

As shown in FIG. 4B, the retaining ring 103 is disposed within the annular groove 307 of the fastener 101. When the fastener 101 is removed from the cylinder head, the retaining ring 103 is secured between the conical surface 401 and the annular groove 307, thereby securing the fastener 101 to the clamp 105. By securing the retaining ring 103 between the conical surface 401 and the annular groove 307, there is a horizontal component to the normal force acting on the retaining ring, resulting in a more secure entrapment of the retaining ring 103. As a result, while the fastener 101 is removed from the cylinder head, the fastener 101 remains secured to the clamp 105, which in turn is coupled to the fuel injector 201. Thus, the clamp assembly 101, 103, and 105 and the fuel injector 201 are collectively removed from the cylinder head. FIG. 4A and FIG. 4B illustrate the limited amount of travel that the fastener 101 and the retaining ring 103 engage in with respect to the clamp 105. More travel than that shown between FIG. 4A and FIG. 4B is possible.

Because the retaining ring 103 is trapped between the fastener 101 and the clamp 105, the chances of the retaining ring 103 coming loose from the assembly are remote. Further, when the retaining ring 103 remains with the clamp 105 and distal from the two ends of the passage during the entire travel of the retaining ring 103 within the passage of the clamp 105, objects external to the clamp 105 are far less likely to dislodge the retaining ring 103 from the annular groove 307. Engine operation and/or vibration are also unlikely to dislodge the retaining ring 103 from the annular groove 307. The medial location of the retaining ring 103 within the passage therefore provides advantage over locations near an end of the passage. Reducing the length of the cylinder 403 provides the fastener 101 with more room to pivot within the clamp 105.

The retaining ring 103 has a cross-sectional diameter d and an inner diameter D as shown in FIG. 1. The cross-sectional diameter d of the retaining ring 103 is advantageously sized relative to the size of the annular groove 307. Ideally, the depth of the annular groove 307 is about half of d, enabling full engagement of the retaining ring 103 with both the annular groove 307 and the conical surface 401. If the annular groove 307 is too deep, then the retaining ring 103 may not sufficiently contact the conical surface 401. If the annular groove 307 is too shallow, then the retaining ring 103 may deform. Advantageously, the inner diameter of the annular groove 307, i.e., the narrowest diameter of the fastener 101 at the annular groove 307 or the deepest point of the annular groove 307, is larger than the inner diameter D of the retaining ring 103. For example, the inner diameter of the annular groove 307 may be a few thousandths of an inch larger than D.

Figure 8:
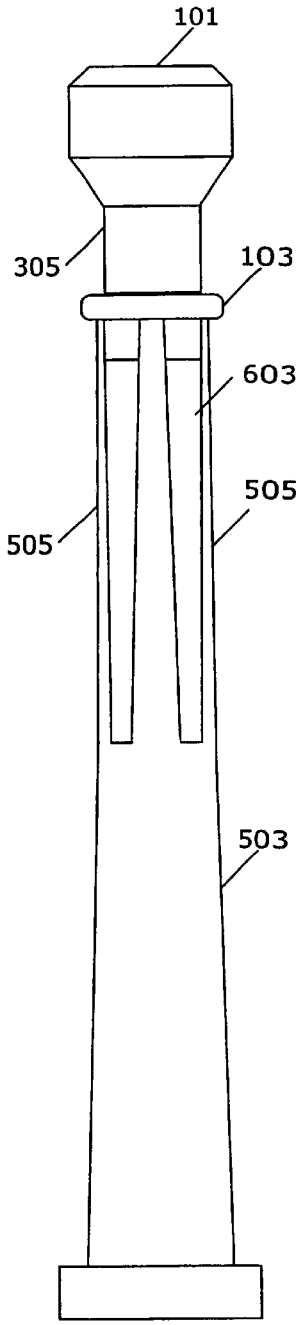
FIG. 8 is a side view of the mandrel and push tool in conjunction with the retaining ring as positioned on the fastener in accordance with the invention.

Because the retaining ring 103 may be comprised of a material that has a cross-sectional diameter to inner diameter ratio d/D that is appropriately lower than the d/D ratio for the ring shown in FIG. 8 of U.S. Pat. No. 6,431,152, the retaining ring 103 is able to stretch further before yielding, which helps to ensure retention of the ring 103 onto the fastener 101 after installation. This ratio d/D is advantageously considered to realize ring 103 retention when manufacturing tolerances are incorporated. The elastic range of the particular material determines its critical d/D range.

In addition, the retaining ring 103 is advantageously a partial toroid, also known as a snap ring, which is advantageously solid. The retaining ring 103 advantageously varies from 180 degrees up to 360 degrees, as compared to the ring shown in FIG. 8 of U.S. Pat. No. 6,431,152 that extends between 185 degrees and 240 degrees. Because the retaining ring 103 covers a larger periphery of a circle, the retaining ring 103 is less likely to be dislodged from the annular groove 307 once installed.

Figure 5:
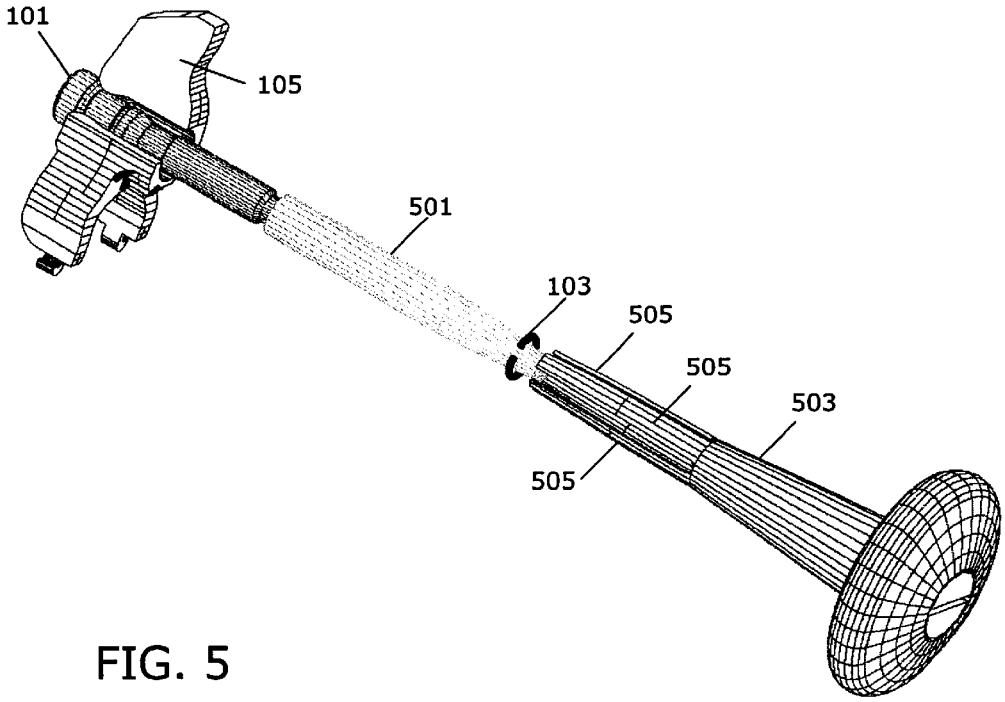
FIG. 5 is a perspective view of the fastener disposed within the injector clamp and a mandrel and push tool utilized to position the retaining ring on the fastener in accordance with the invention.

A perspective view of the fastener disposed within the injector clamp and a mandrel and push tool that may be utilized to position the retaining ring on the fastener is shown in FIG. 5. The fastener 101 is inserted into one end of the passage of the clamp 105 such that the threaded section 313 passes through a second end of the passage, and at least part of the threaded section 313 is outside the clamp 105. A first section of a mandrel 501, having at least a partially hollow interior, is positioned over the threaded section 313 to cover it. The retaining ring 103 slides onto a tapered section of the mandrel 501. A push tool 503, having expandable tines or fingers 505, is utilized to push the retaining ring 103 over the tapered section of the mandrel 501, onto and across the first section of the mandrel 501, and into the annular groove 307 on the fastener 101, thereby securing the fastener to the clamp.

Figure 6:
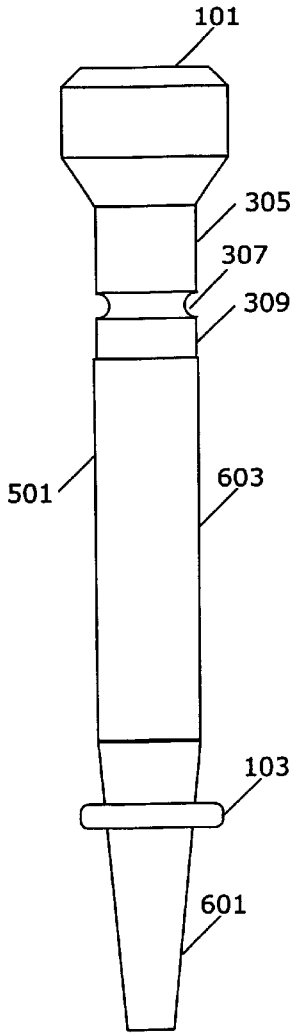
FIG. 6 is a side view of the retaining ring disposed on the mandrel that is disposed on the fastener in accordance with the invention.

A side view of the retaining ring 103 disposed on the mandrel 501 that is disposed on the fastener 101 is shown in FIG. 6. Although the fastener 101 is disposed on the clamp 105 at this time, the clamp 105 is not shown in FIG. 6 for the sake of clarity. The mandrel 501 provides the capability of sliding the retaining ring 103 into the annular groove 307 without damaging either the retaining ring 103 or the threads 313 of the fastener 101. The mandrel 501 provides a gradual lead-in angle to expand the retaining ring 103 in the annular groove, resulting in less force necessary to install the ring 103 on the fastener 101. The retaining ring 103 is slid onto the tapered section 601 of the mandrel 501. The tapered section 601 has a minimum diameter at its smallest end that is smaller than the inner diameter of the retaining ring 103, thereby allowing the retaining ring 103 to easily slide onto the mandrel 501. The tapered section 601 tapers from its minimum diameter to the diameter of a cylindrical section 603 of the mandrel 501. The cylindrical section 603 preferably has an outer surface that is smooth enough to allow the retaining ring to slide across the outer surface without great difficulty. The outer diameter of the cylindrical section 603 is substantially the same size as the outer diameter of the lower section 309 of the cylindrical segment. The cylindrical section 603 is hollow, to allow the mandrel 501 to slide over the threaded section 313 of the fastener 101.

Figure 7:
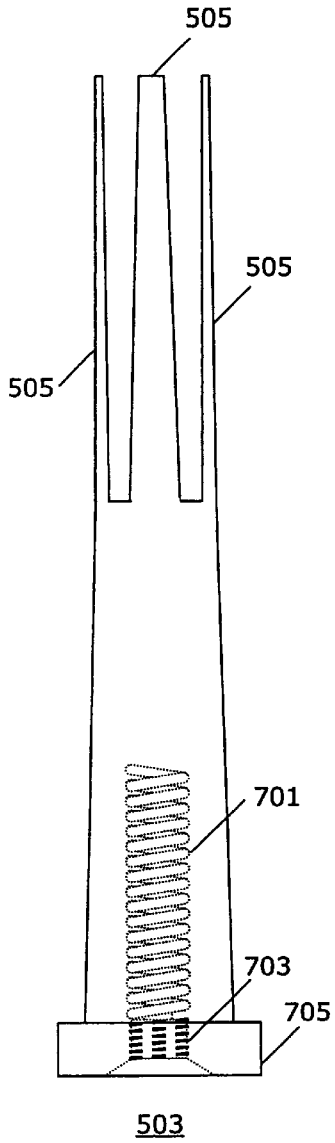
FIG. 7 is a side view of the push tool in accordance with the invention.

A side view of the push tool is shown in FIG. 7. The push tool 503 is generally hollow with a plurality of expandable tines 505 disposed at one end. The tines 505 push the retaining ring along the outer periphery of the mandrel 501 while the mandrel 501 slides into the hollow interior of the push tool 503. The tines 505 expand slightly in a radial direction to fit over the outer periphery of the mandrel 501.

A spring 701 is disposed within the push tool 503 to assist in removing the mandrel 501 from the hollow interior of the push tool 503 once the retaining ring 103 is positioned on the fastener 101. One end of the spring 701 is disposed on a protrusion on a threaded fastener 703 that is screwed into the pommel 705 of the push tool 703.

A side view of the mandrel and push tool in conjunction with the retaining ring as positioned on the fastener is shown in FIG. 8. Although the fastener 101 is disposed on the clamp 105 at this time, the clamp 105 is not shown in FIG. 8 for the sake of clarity. The cylindrical section 603 of the mandrel 501 covers the threads 313 of the fastener 101 while the push tool 503 pushes the retaining ring 103 over the mandrel 501, onto the fastener 101, and into annular groove 307. The tines 505 abut against the retaining ring 103 to push it into position. The tines 505 expand slightly to allow the mandrel 501 to slide inside the hollow interior of the push tool 503. Once the retaining ring is in position, the spring 701 within the push tool 503 assists in removing the mandrel 501 from within the push tool 503. At this time, the clamp 105 is secured between the neck 303 of the fastener 101 and the retaining ring 103, such that the clamp assembly 101, 103, and 105 and the injector 201 are removed together when the fastener 101 is removed, e.g., unscrewed, from the cylinder head.

Although the present invention is described above with respect to a fuel injector fastened to a cylinder head, it is possible to utilize the clamp and fastener approach to devices other than a fuel injector and to devices fastened to platforms other than a cylinder head. Thus, the present invention provides a method and apparatus for removing the clamp and device together from the platform.

The present invention provides a method and apparatus for fastening a fuel injector clamp to a cylinder head while providing that the clamp is removed from the cylinder head together with the fuel injector. A retaining ring is secured between a conical surface of the clamp and a fastener within a passage of the clamp to retain the clamp with the fastener as the fastener is removed. The retaining ring is distal from both ends of the passage, thereby preventing external objects from dislodging the retaining ring. Thus, the tolerances for manufacturing the clamp assembly may be looser while providing successful operation. The arrangement utilized to secure the retaining ring is more robust, thus separation of the retaining ring from the fastener is less likely. A mandrel and push tool are also provided to position the retaining ring on the fastener without damaging the retaining ring or the threads on the fastener.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

a clamp for use with a fuel injector disposed in a cylinder head, the clamp having a passage that comprises a conical surface;

a fastener disposed within the passage of the clamp and having an annular groove;

a retaining ring disposed in the annular groove, wherein the retaining ring is secured between the conical surface of the clamp and the annular groove when the fastener is removed from the cylinder head to thereby allow the apparatus to be removed together with the fuel injector.

2. The apparatus of claim 1, wherein the retaining ring is medially located between two ends of the passage during all travel of the retaining ring with respect to the clamp.

3. The apparatus of claim 1, wherein the retaining ring is a partial toroid that extends between 180 degrees and 360 degrees.

4. The apparatus of claim 1, wherein the retaining ring has a cross-sectional diameter to inner diameter ratio that is small.

5. The apparatus of claim 1, further comprising:

a mandrel having a first section with a substantially smooth outer surface that is positioned over a plurality of threads on the fastener and having a second section that is tapered and has a minimum outer diameter that is smaller than an inner diameter of the retaining ring;

a push tool having a hollow interior and a plurality of expandable tines that push the retaining ring along the tapered second section of the mandrel, across the first section of the mandrel, and into the annular groove while the mandrel slides into the hollow interior of the push tool.

6. The apparatus of claim 5, further comprising a spring disposed within the push tool such that the spring assists in removing the mandrel from the hollow interior of the push tool.

7. An apparatus comprising:

a fastener having a cylindrical segment with an outer diameter and having an annular groove disposed in the-cylindrical segment;

a retaining ring disposed within the annular groove;

a clamp comprising:

a securing device capable of securing a fuel injector within a cylinder head of an internal combustion engine; and a passage characterized at least in part by a cylindrical surface that is slightly larger than the outer diameter of the cylindrical segment of the fastener and characterized at least in part by a conical surface extending away from the cylindrical surface such that the retaining ring is secured between the annular groove and the conical surface to thereby allow the apparatus and the fuel injector to be removed together from the cylinder head.

8. The apparatus of claim 7, wherein the retaining ring is located distally from two ends of the passage during all travel of the retaining ring.

9. The apparatus of claim 7, wherein the retaining ring is a partial toroid that extends between 180 degrees and 360 degrees.

10. The apparatus of claim 7, wherein the retaining ring has a cross-sectional diameter to inner diameter ratio that is small.

11. The apparatus of claim 7, wherein the fastener further comprises a plurality of threads having an outer diameter that is smaller than the outer diameter of the cylindrical segment of the fastener.

12. The apparatus of claim 11, further comprising a mandrel comprising:

a hollow first section with an outer diameter that is substantially the same as the outer diameter of the cylindrical segment of the fastener, such that the first section slides over the plurality of threads; and a tapered section that tapers from a minimum diameter to the diameter of the first section, wherein the minimum diameter is smaller than an inner diameter of the retaining ring;

wherein the retaining ring is slidable along the tapered section, onto the first section, across the first section, and into the annular groove of the fastener.

13. The apparatus of claim 12, further comprising a push tool having a hollow interior and a plurality of expandable tines that push the retaining ring along an outer perimeter of the mandrel while the mandrel slides into the hollow interior of the push tool.

14. The apparatus of claim 13, further comprising a spring disposed within the push tool such that the spring assists in removing the mandrel from the hollow interior of the push tool.

15. A method comprising the steps of:

inserting a fastener in a first end of a passage of a clamp such that a plurality of threads on the fastener passes through a second end of the passage of the clamp, wherein the clamp is capable of clamping a fuel injector to a cylinder head when the fastener is fastened to the cylinder head;

covering the plurality of threads with an first section of a mandrel having a second section that is tapered;

sliding a retaining ring on the tapered second section;

pushing the retaining ring over the tapered second section, across the first section, and into an annular groove on the fastener, thereby securing the fastener to the clamp.

16. The method of claim 15, further comprising the step of removing the mandrel.

17. The method of claim 15, wherein the step of pushing comprises pushing a push tool having a hollow interior and expandable tines disposed at one end, such that the mandrel slides inside the push tool while the retaining ring slides outside the mandrel.

18. The method of claim 15, further comprising the steps of:

coupling the clamp to a fuel injector;

fastening the fastener to a cylinder head while positioning the fuel injector into a position in the cylinder head.

19. The method of claim 15, further comprising the step of unfastening the fastener from the cylinder head, thereby collectively removing the fastener, the clamp, the retaining ring, and the fuel injector from the cylinder head.

20. An apparatus comprising:

a clamp capable of clamping a device to a platform, the clamp having a passage that comprises a conical surface;

a fastener disposed within the passage of the clamp and having an annular groove, wherein the fastener is capable of being fastened to the platform;

a retaining ring disposed in the annular groove, wherein the retaining ring is secured between the conical surface of the clamp and the annular groove when the fastener is removed from the platform to thereby allow the apparatus to be removed together with the device.

* * * * *